US005110351A

United States Patent [19]

Hunter et al.

[11] Patent Number: 5,110,351

[45] Date of Patent: May 5, 1992

[54] METHOD OF PROMOTING THE DECARBURIZATION REACTION IN A VACUUM REFINING FURNACE

[75] Inventors: Phillip B. Hunter, Westmoreland County, Pa.; Chang-Long Chou, Tainan; Muh-Shuh Wang, Taichung, both of Taiwan

[73] Assignee: USX Corporation, Pittsburgh, Pa.

[21] Appl. No.: 639,619

[22] Filed: Jan. 10, 1991

[51] Int. Cl.[5] ..... B22D 27/20; C22C 7/10

[52] U.S. Cl. ..... 75/508

[58] Field of Search ..... 75/508

[56] References Cited

U.S. PATENT DOCUMENTS

| | | | |
|---|---|---|---|
| 3,337,330 | 8/1967 | Fiwkl | 75/508 |
| 3,342,589 | 9/1967 | Ichinose | 75/508 |
| 3,749,567 | 7/1973 | Stephenson et al. | 75/60 |
| 3,793,000 | 2/1974 | Miltenberger | 75/508 |
| 3,810,753 | 5/1974 | Miltenberger | 75/508 |
| 3,954,445 | 5/1976 | Fruehan | 75/51 |
| 4,071,356 | 1/1978 | Yamamota et al. | 75/59 |
| 4,152,140 | 5/1979 | Hori et al. | 75/49 |
| 4,426,224 | 1/1984 | Shimme et al. | 75/49 |
| 4,564,390 | 1/1986 | Gupta et al. | 75/51.7 |
| 4,612,043 | 9/1986 | Gray et al. | 75/49 |
| 4,652,306 | 3/1987 | Nakashima et al. | 75/10.17 |

*Primary Examiner*—Peter D. Rosenberg
*Attorney, Agent, or Firm*—Donald M. Satina

[57] ABSTRACT

This invention describes a method to promote the decarburization reaction of the molten steel in a vacuum refining furnace by adding manganese ore into the molten steel.

The added manganese ore melts and release oxygen into the steel bath with the additional dissolved oxygen content effectively promoting the decarburization reaction of carbon steel, even below the 50 ppm level of ultra-low carbon content. The addition of the manganese ore increases the oxygen content of molten steel and enables the vacuum degassification treatment to have an effect similar to that of gaseous oxygen blowing without the excessive refractory erosion of the vacuum chamber lining. In this manner, baths having relatively high carbon contents and/or low dissolved oxygen contents can be effectively decarburized to ultra low carbon levels. This invention and the addition technique are not limited in application to RH vacuum-degassing equipment. Most vacuum furnaces are in general suitable for applying this manganese ore addition for the purpose of facilitating the production of ultra-low carbon steel.

12 Claims, 6 Drawing Sheets

METHOD OF PROMOTING THE DECARBURIZATION REACTION IN A VACUUM REFINING FURNACE

TECHNICAL FIELD

This invention relates to the decarburization of steel and, more particularly, to an improved method for producing ultra-low carbon steel without the introduction of gaseous oxygen.

BACKGROUND ART

Ultra-low carbon steel can be produced in an integrated steel mill by a vacuum decarburization treatment following initial decarburization or refinement of the steel, such as through the basic oxygen steelmaking process (BOF) or through the bottom-blown oxygen steelmaking process (Q-BOP). Steel is refined when oxygen is introduced into the molten metal bath and combines with carbon, removing the carbon as carbon monoxide and lowering the carbon content of the molten bath. In a basic oxygen furnace, oxygen is blown from the top into a molten bath of steel at atmospheric pressure while in the Q-BOP process, oxygen is introduced through tuyeres in the bottom of the vessel and passes upwardly through the bath. Following decarburization, dissolved oxygen is retained in the steel. Subsequently, a vacuum-degassing process, such as the RH (Ruhrstahl-Heraeus) process, is able to utilize the dissolved oxygen in the molten steel under a high vacuum condition for further decarburization.

For the production of ultra-low carbon steel (50 ppm and lower), oxygen is blown for a longer period of time during refinement than for other steel grades, resulting in the carbon content of molten steel at tapping being reduced to a low level of 0.015–0.025% and the dissolved oxygen content being maintained at a very high level on the order of 500–700 ppm. Beginning with this very low carbon and very high dissolved oxygen, RH vacuum-degassing equipment, operating at a vacuum below 10 Torr, is able to decrease the carbon content in the molten steel below 50 ppm (0.005%) in a treatment time of about 20 minutes. As the dissolved oxygen content is increased above the minimum level necessary for decarburization, the higher oxygen content results in a faster oxygen-carbon reaction and, together with the lower initial carbon content, results in a shorter decarburization treatment time. Conversely, if the initial carbon content is higher than 0.025% and/or the initial dissolved oxygen content is less than 500 ppm, the vacuum treatment time must be extended to achieve the ultra-low carbon levels. Unfortunately, for baths having too high a carbon content and/or too low of a dissolved oxygen content, the prolonged treatment time often fails to decarburize the molten steel to a level below 50 PPM, acting merely to increase production time.

When a Q-BOP is used for refinement, more efficient use is made of the oxygen for decarburization, resulting in the dissolved oxygen content of the refined steel being lower than that of steel produced by a BOF. Therefore, steel produced in a Q-BOP for subsequent decarburization in a vacuum-degasser may require the addition of oxygen for decarburization to ultra-low levels.

One solution to both of these situations has been the use of an RH-OB treatment. The RH-OB vacuum-degassification system employs tuyeres in a vacuum refinement section for the introduction of oxygen into the steel, assisting decarburization. When oxygen is not required, an inert gas, such as argon, must be delivered through the tuyeres to prevent plugging of the tuyeres during degassing. The argon blown into the RH-OB vacuum chamber acts as a coolant and results in the formation of a solidified metal shell, commonly referrred to as a "skull", in the vessel which must be removed as often as every two to three days and which requires two to three days for removal before the vessel can be reused, causing delays in availability, reducing refractory life and resulting in high operating costs. To circumvent the loss of vessel availabililty during deskulling, the vessel with the skull is moved to a maintenance position and a second vessel is moved into the operating position. This equipment configuration is a more expensive facility than a single vessel facility. Consequently, RH-OB vacuum-degasser with a quick vessel exchange practice is much more expensive than a single RH vacuum-degasser in equipment cost.

What is needed is a method of adding controlled amounts of dissolved oxygen to a molten bath of steel without directly adding gaseous oxygen.

The invention is a method to promote the decarburization reaction in the vacuum refining section of an RH vacuum-degasser by employing the controlled addition of manganese ore without the operating problems that result from the direct addition of gaseous oxygen and argon. The added manganese ore is melted at a high temperature to release oxygen into the molten steel. The manner and quantity of addition are adjustable to the reaction requirement for which oxygen is required to supplement the oxygen already dissolved in the molten steel to facilitate the smooth and expectable production of ultra-low carbon steel. Owing to the addition of manganese ore to increase the oxygen content of the molten steel, a broader variety of initial molten steel conditions can be successfully treated by the RH process and, more particularly, a steel having a higher carbon content or lower oxygen content can be decarburized to ultra-low levels in a relatively short treatment time. This is extremely important in that it increases the rate at which the optimum vacuum treatment is obtained and partially releases the blowing burden of the basic oxygen furnace or Q-BOP, resulting in increased steelmaking productivity and furnace availability.

This invention is also applicable to some vacuum decarburization processes other than those employing an RH vacuum degasser, for example, an electrical refining furnace equipped with vacuum treatment.

SUMMARY OF THE INVENTION

A method of decarburizing a molten steel bath to an ultra low level of less than 0.005% carbon without the direct addition of gaseous oxygen, is described in which the molten steel bath initially contains a relatively low level of dissolved oxygen of less than about 500 ppm (0.050%), the decarburization taking place in a vessel under vacuum, the method comprising the steps of (a) calculating a predetermined amount of manganese ore to be added to the bath, said predetermined amount being based on the initial carbon content, the initial oxygen content, and the desired final carbon content, (b) adding said predetermined amount of manganese ore to said bath, and (c) placing said ore and said bath under a vacuum condition for a predetermined period of time sufficient for decomposition of the manganese ore and reaction of the oxygen from the ore with the carbon in the bath to lower the carbon content of the bath.

BRIEF DESCRIPTION OF THE DRAWINGS

The invention will be more clearly understood from the following description when read in conjunction with the accompanying drawings, wherein.

DESCRIPTION OF THE PREFERRED EMBODIMENT

Figure 1:
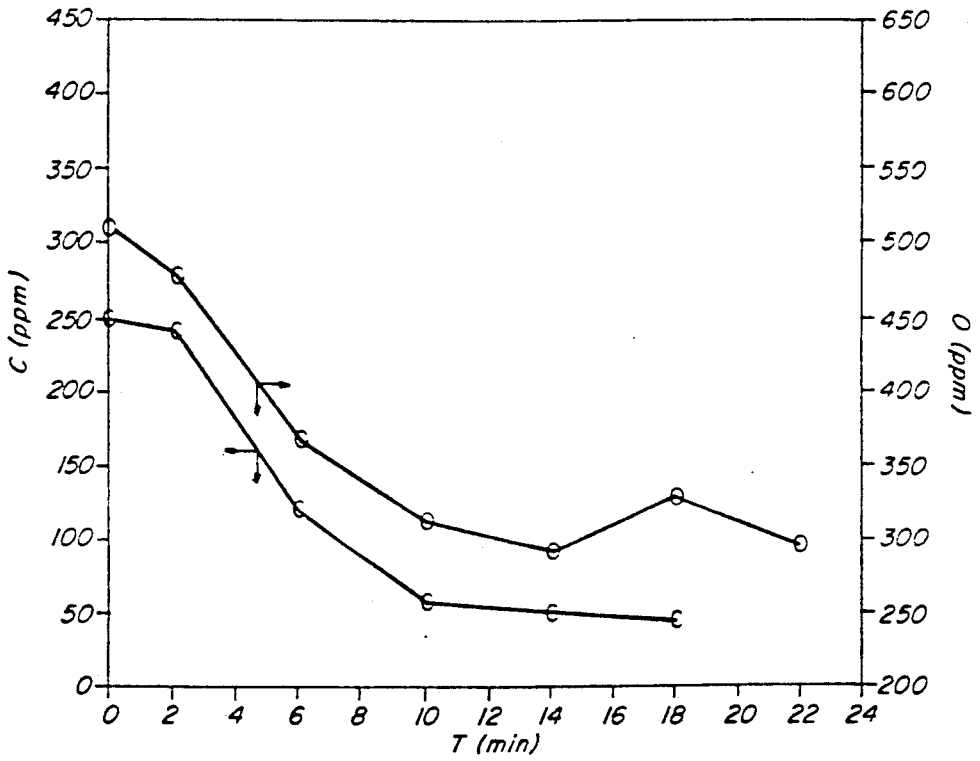
FIG. 1 illustrates the decreasing paths of the carbon and oxygen contents with treatment time in an RH vacuum-degasser.

The carbon content of a steel bath produced through a conventional BOF refinement process for further decarburization to ultra low levels is around 0.015% to 0.025% with a dissolved oxygen content above 500 ppm (0.050%). Using RH vacuum-degassification equipment operating at about 1.0 to 10 Torr, the carbon content of steel containing this relatively high oxygen content and low carbon content can be lowered to below 50 ppm (0.005%) in about 20 minutes. FIG. 1 illustrates the decreasing paths of the carbon content (C) and oxygen content (O) with RH treatment time (T).

Under these vacuum conditions, the decarburization reaction proceeds according to the following:

$$C+O \rightleftharpoons CO(g) \quad (1)$$

The equilibrium constant for this reaction is expressed as:

$$K_{c-o} = \frac{Pco\ (atm)}{[\%\ C][\%O]} \quad (2)$$

At the normal operating temperature of 1600° C. (2910° F.), $K_{co}$ is 432.6. Inserting this constant $K_{co}$ into equation (2) leads to the following result:

$$[\%C]\times[\%O]=0.0023Pco\ (atm). \quad (3)$$

Figure 2:
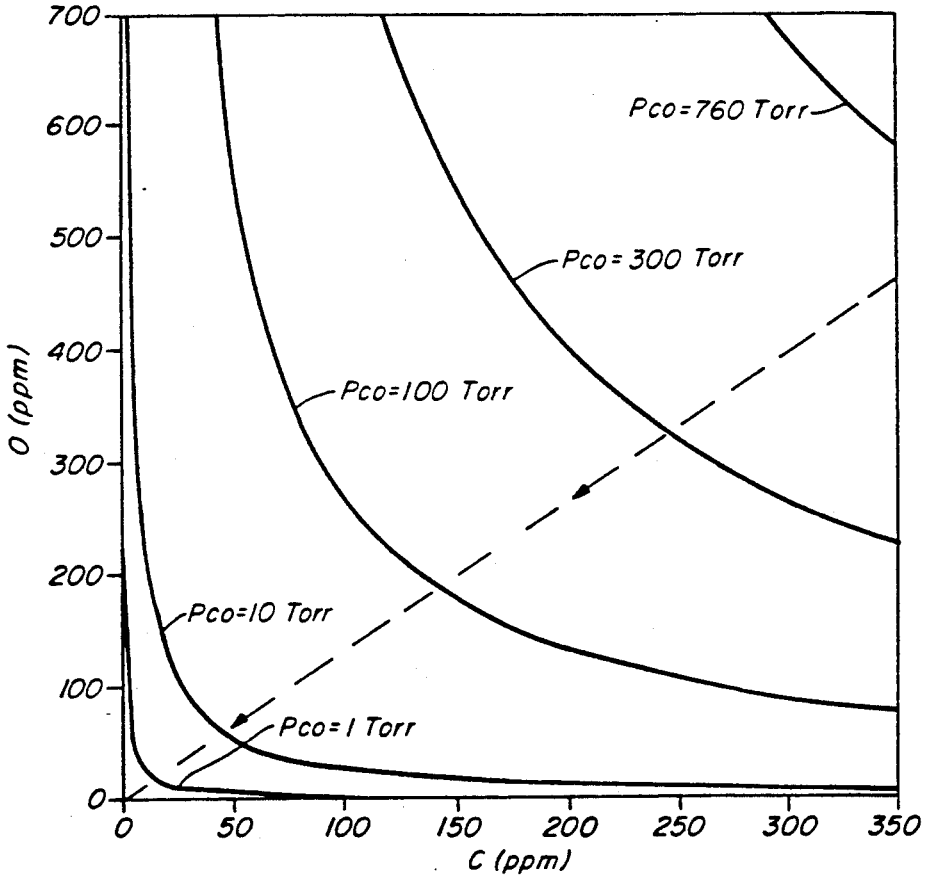
FIG. 2 illustrates the equilibrium curves of the carbon-oxygen reaction under vacuum pressure at 1600° C.
Figure 3:
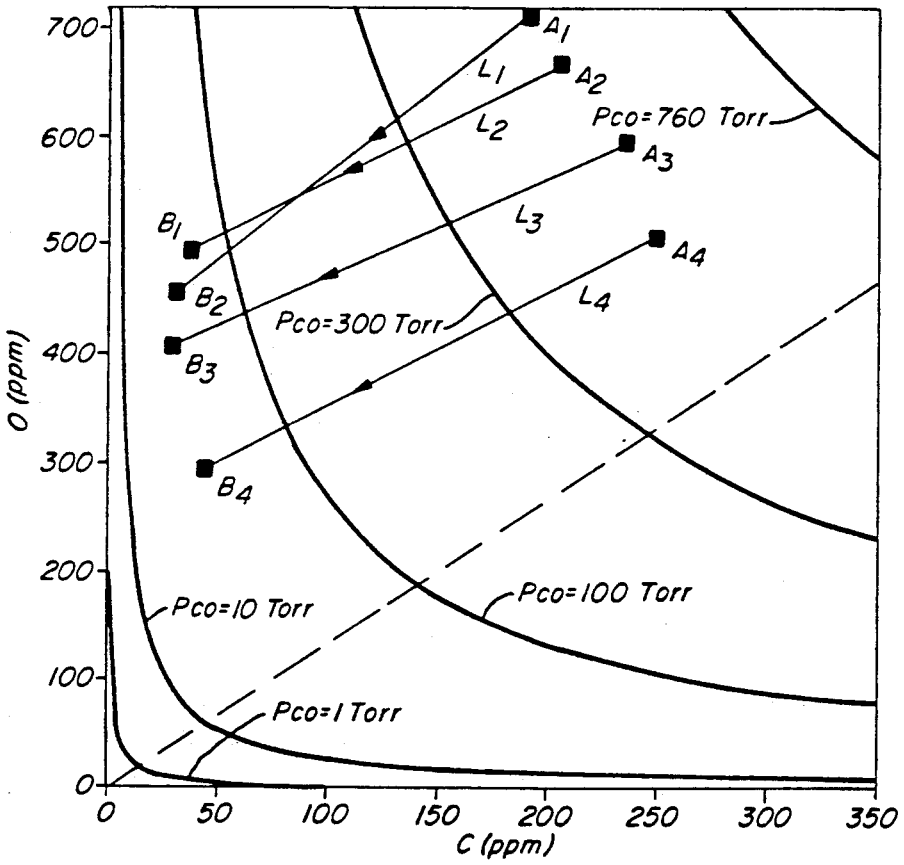
FIG. 3 depicts typical decarburization paths for the RH process at a vacuum of below 10 Torr with A indicating initial carbon and oxygen contents and B illustrating end results without the addition of manganese ore.

FIG. 2 illustrates the equilibrium curves of the carbon-oxygen reaction corresponding to Equation (3). The dashed line across FIG. 2 indicates the reaction path of equimolar removal of oxygen and carbon. For example, 16 grams (0.035 pounds) of oxygen can effectively consume 12 grams (0.026 pounds) of carbon. The solid lines L1 through L4 in FIG. 3 depict typical decarburization at a final vacuum of about 1.0 to 10 Torr with A1-A4 indicating initial carbon content (C) and oxygen content (O) and B1-B4 being illustrative of end results. However, the very high oxygen contents (500-700 ppm) of the steel baths represented by lines L1 through L4 are only obtainable through prolonged blowing of oxygen during the initial refinement stage, increasing the length of the initial refinement stage and decreasing the steelmaking productivity rate. The prolonged blowing will also increase the FeO content of the slag, which will accellerate the wear of the furnace and decrease furnace availability.

According to the invention, the oxygen content of a bath to be decarburized having a relatively low level of dissolved oxygen is increased through the addition of manganese ore. Such a bath is obtainable by shortening the oxygen blowing time during initial refinement with a BOF, with a resulting decrease in the production time and an increase in the productivity rate. Also, such a bath is the normal result of the highly oxygen efficient Q-BOP process.

The naturally occuring manganese ore nominally contains more than 70 weight percent manganese dioxide ($MnO_2$), a few weight percent of iron oxide, silica and alumina, and residual carbonates. The major constituent of manganese ore, $MnO_2$, is susceptable to decomposition at elevated temperatures according to the following reaction:

$$MnO_2 \rightarrow MnO + O$$

Further decomposition of the manganese oxide proceeds according to the following:

$$MnO + C \rightleftharpoons Mn + CO(g)$$

This is the reaction mechanism of manganese ore to effectively supply additional dissolved oxygen to the molten steel and to promote the decarburization reaction when the manganese ore is added to the steel bath.

Other oxides are also capable of releasing oxygen as they are decomposed. Table 1 represents the trial comparison of manganese ore and iron ore. Both were introduced into a steel ladle by a wire feeding technique in which the oxide is ground into a powder, the powder is encased in a consummable metal tube, and the tube is introduced into the bath. As observable from the oxygen recovery ratio of Table 1, the oxygen recovery ratio of manganese ore for this test was far superior to that of iron ore. This oxygen recovery ratio can be used to calculate the amount of manganese ore which must be added to achieve a predetermined increase in the dissolved oxygen content of the bath sufficient for combination with carbon in the bath to decarburize the bath to an aim carbon level.

TABLE 1

Ladle wire feeding test result of oxide addition

| Material | Iron ore | Manganese ore |
|---|---|---|
| Initial oxygen (ppm) | 402 | 410 |
| Wire feeding length (feet [M]) | 1012 [308] | 726 [221] |
| Final oxygen (ppm) | 442 | 506 |
| Oxygen increment (ppm) | 40 | 96 |
| Theoretical oxygen increment (ppm) | 164 | 110 |
| Oxygen recovery ratio | 24% | 87% |

Figure 4:
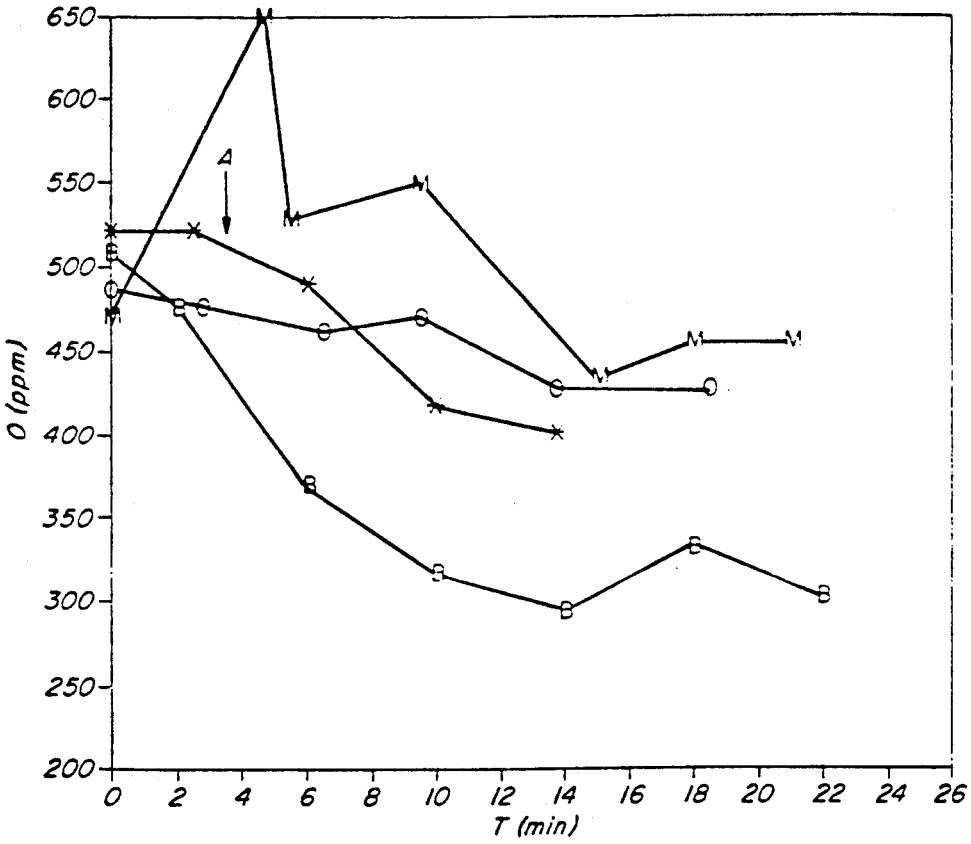
FIG. 4 represents the oxygen content vs treatment time with a manganese ore addition into a RH vacuum-degasser at the initial phase.

The test results of manganese ore additions into an RH vacuum degasser are shown in FIG. 4. For these trial heats, manganese ore was crushed, screened, dried and added in bulk form. For addition to a vacuum degasser, the ore must be properly sized since if it is too fine, it will escape into the vacuum system and if it is too large, it will take a long time to smelt. The optimum ore size for this application is ⅜ inch to 2 inches (9.5 to 50.4 mm) in diameter. The changing path of the oxygen content (O) during the vacuum decarburization treatment time (T) indicates the oxygen increment when manganese ore is added to the bath (point A) and releases oxygen upon melting during the initial phase of the vacuum treatment.

The amount of the oxygen increment is proportional to the quantity of manganese ore added for a given heat size. For these trial heats, for which the heat size was 250 metric tons (275 short tons), "B" represents the base heat with no manganese ore addition, to "*" was added 121 kg (266 lb) of manganese ore, to "O" was added 250 kg (550 lb), and to "M" was added 350 kg (770 lb).

Figure 5:
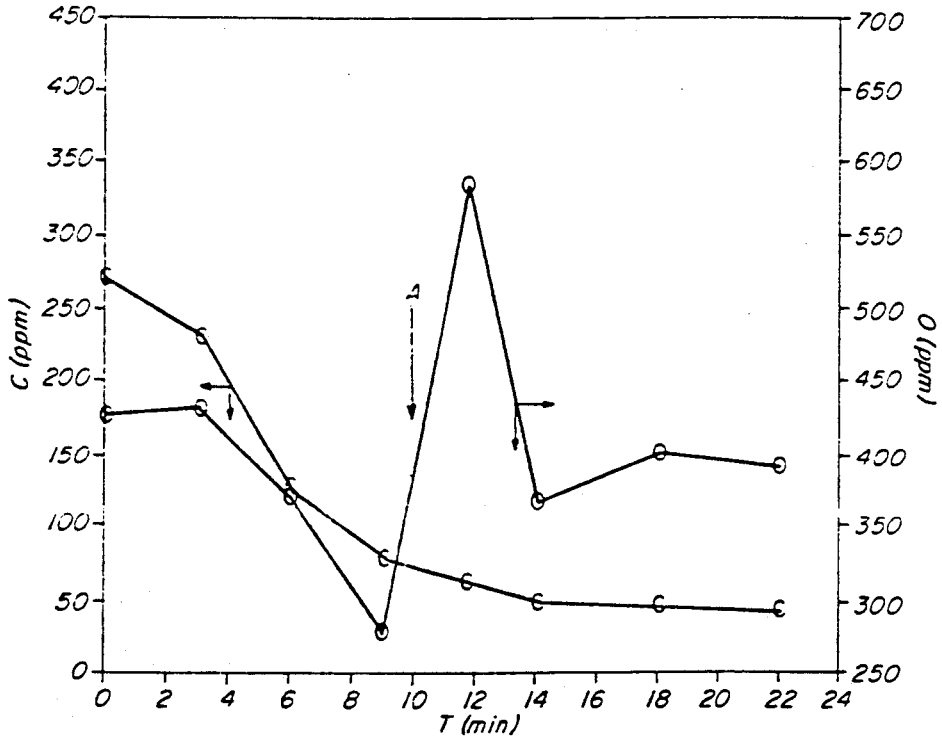
FIG. 5 illustrates a spike on the oxygen content curve indicative of a manganese ore-induced oxygen increment shortly after middle phase manganese ore addition.

The manganese ore can also be added at the middle phase of vacuum treatment. FIG. 5 illustrates a manganese ore-induced oxygen increment as a spike on the oxygen content curve shortly after the manganese ore is added at point A. The oxygen content (O) versus RH treatment time (T) paths illustrated in FIG. 4 and FIG. 5 imply that the timing of the manganese ore addition is very flexible and is simply determined by the processing situation.

Figure 6:
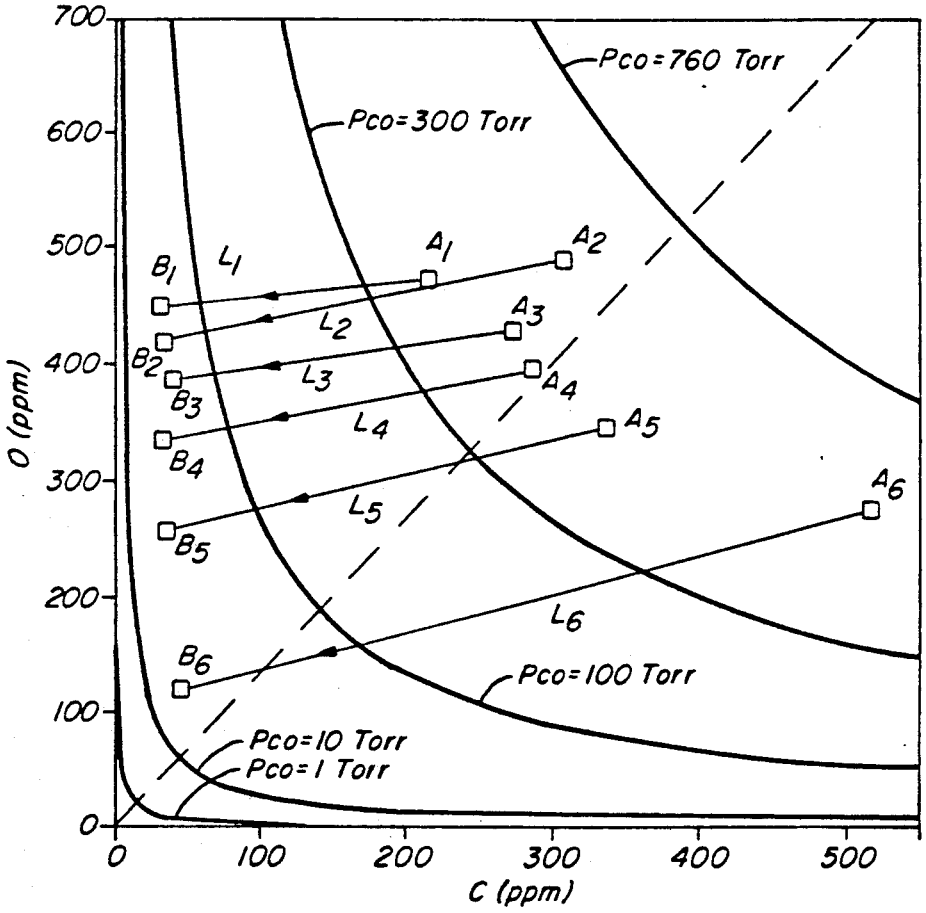
FIG. 6 depicts the vacuum treatment results obtained in trials in which manganese ore was added to an RH vacuum-degasser.

The vacuum treatment carbon content (C) and oxygen content (O) obtained in trials in which manganese ore was added to an RH degasser are shown in FIG. 6. The dashed line is again the equimolar removal line. However, all the treatment paths L1 through L6 are not parallel to the dashed line. This is the indication of additional oxygen to take part in the vacuum decarburization process. In the most extreme example of FIG. 6, the heat represented by L6 had an initial carbon content of more than 500 ppm and initial oxygen content less than 300 ppm (point A6). Ultra low carbon levels would not be achievable for such a heat using the conventional RH process. Through the addition of manganese ore, the dissolved oxygen content was raised sufficiently that the carbon content of this heat was brought down to 50 ppm (point B6) in a regular treatment time of about 30 minutes, about 20 minutes of which was under vacuum.

All of the treatment results clearly demonstrate the effectiveness of a manganese ore addition to facilitate the production of ultra-low carbon steel and illustrate that this invention is particularly valuable for the situation in which the steel bath initially has too low of an oxygen content and/or too high of a carbon content for conventional decarburization treatment in an RH degasser. Use of the invention permits tapping at a higher carbon content and lower dissolved oxygen content, decreasing the heat time and increasing productivity. An added advantage of tapping at a higher carbon content and lower dissolved oxygen content is that the residual content of Mn in the bath is higher than that of a bath tapped at a lower carbon content and higher dissolved oxygen content after additional oxygen blowing. This higher residual Mn content, together with the Mn recovered from the manganese ore, reduces the amount of very expensive, low carbon ferromanganese which must be added to alloy the heat.

The invention is also useful for providing dissolved oxygen to a molten steel bath for other purposes. One such situation in which excess oxygen is required is for baths which are below the optimum pouring temperature. Aluminum or another exothermic material is then added to the bath, reacts with the dissolved oxygen and releases heat to warm the bath.

We claim as our invention:

1. A method of decarburizing a molten steel bath to an ultra low level of less than 0.005% carbon, the molten steel bath containing a relatively low level of dissolved oxygen of less than about 500 ppm, said decarburization taking place in a vessel under vacuum, and method comprising:

determining the dissolved oxygen increment required for addition to the bath to achieve an aim final carbon content based on the initial carbon content and the initial oxygen content of the bath;

calculating an amount of manganese ore to be added to the bath, said manganese ore having as a major constituent manganese dioxide ($MnO_2$) and having a predetermined oxygen recovery ratio, said amount being calculated based on the oxygen recovery ratio to provide at least the required dissolved oxygen increment;

adding said calculated amount of manganese ore to said bath; and placing said ore and said bath under a vacuum condition for a predetermined period of time, said predetermined period of time being sufficient for supply of the required oxygen increment to the bath by decomposition of the manganese ore and for the reaction of the oxygen from the ore with the carbon in the bath to lower the carbon content of the bath.

2. The method according to claim 1 wherein the vessel is under a vacuum of at least 10 Torr.

3. The method according to claim 2 wherein the manganese ore is crushed and sized prior to being added to the bath, the ore added to the bath being less than 2 inches (50.4 mm) in diameter.

4. The method according to claim 3 wherein the manganese ore being added to the bath is more than ⅜ inches (9.5 mm) in diameter.

5. The method according to claim 2 wherein the manganese ore is crushed to a powder and the powder is encased in a consummable metal tube prior to being added to the bath.

6. The method according to claim 5 wherein the decarburization vessel is an RH degasser.

7. The method according to claim 4 wherein the decarburization vessel is an RH degasser.

8. An improved method of producing a steel having an ultra low carbon level of less than 0.005%, said method comprising:

initially refining a bath of molten metal through a basic oxygen process wherein oxygen is blown into the molten metal bath in an amount sufficient to reduce the carbon level to about 0.025 to 0.050% carbon with the dissolved oxygen level of the bath being less than about 0.050% oxygen;

determining the dissolved oxygen increment required to decarburize the bath to an aim final carbon level based on the carbon content and the oxygen content of the bath;

placing the refined molten metal bath under a vacuum of 10 Torr or lower;

maintaining the molten bath under the vacuum of 10 Torr or lower for the predetermined time; and adding a calculated amount of manganese ore to the bath, the manganese ore having as a major constituent manganese dioxide ($MnO_2$) and having a predetermined oxygen recovery ratio, the amount of ore being calculated to provide at least said required minimum dissolved oxygen increment based on the oxygen recovery ratio of the ore;

the predetermined time being sufficient for decomposition of the manganese ore and for reaction of sufficient carbon in the bath with oxygen release upon melting of the manganese ore to lower the carbon content of the bath to at least the aim ultra low carbon level.

9. The method according to claim 8 wherein the manganese ore is added in bulk form, the ore having been crushed prior to being added, the ore also being sized for addition only of ore between ⅜ to 2 inches (9.5 to 50.8 mm) in diameter.

10. The method according to claim 9 wherein the molten metal bath is maintained under a vacuum in an RH degasser.

11. The method according to claim 8 wherein the manganese ore is crushed into a powder, dried and encased in a consummable metal tube prior to being added to the bath.

12. The method according to claim 11 wherein the molten metal bath is maintained under a vacuum in an RH degasser.

* * * * *